US010805740B1

(12) United States Patent
Snyder

(10) Patent No.: US 10,805,740 B1
(45) Date of Patent: Oct. 13, 2020

(54) HEARING ENHANCEMENT SYSTEM AND METHOD

(71) Applicant: Ross Snyder, Austin, TX (US)

(72) Inventor: Ross Snyder, Austin, TX (US)

( * ) Notice: Subject to any disclaimer, the term of this patent is extended or adjusted under 35 U.S.C. 154(b) by 0 days.

(21) Appl. No.: 16/206,352

(22) Filed: Nov. 30, 2018

Related U.S. Application Data

(60) Provisional application No. 62/593,442, filed on Dec. 1, 2017.

(51) Int. Cl.
*H04R 25/00* (2006.01)
*G10L 21/0208* (2013.01)

(52) U.S. Cl.
CPC ..... *H04R 25/43* (2013.01); *H04R 25/356* (2013.01); *H04R 25/405* (2013.01); *H04R 25/552* (2013.01); *H04R 25/554* (2013.01); *H04R 25/70* (2013.01); *G10L 21/0208* (2013.01); *H04R 2225/43* (2013.01); *H04S 2420/01* (2013.01)

(58) Field of Classification Search
CPC .... H04R 25/43; H04R 25/356; H04R 25/405; H04R 25/552; H04R 25/70; H04R 2225/43; G10L 21/0208; H04S 2420/01
See application file for complete search history.

(56) References Cited

U.S. PATENT DOCUMENTS 9,699,546 B2 * 7/2017 Qian ..... H04R 5/04
2007/0244698 A1 * 10/2007 Dugger ..... G10L 21/02 704/228
2008/0201138 A1 * 8/2008 Visser ..... G10L 21/0208 704/227
2014/0337016 A1 * 11/2014 Herbig ..... H04M 3/568 704/201
2017/0180879 A1 * 6/2017 Petersen ..... H04R 25/305
2018/0007490 A1 * 1/2018 Lehtiniemi ..... G10L 21/0208
2019/0259409 A1 * 8/2019 Variani ..... G10L 15/16

* cited by examiner

*Primary Examiner* — Regina N Holder

(57) ABSTRACT

An apparatus, system, and method for selectively enhancing a desired sound while suppressing noise is provided. An apparatus comprises a plurality of microphones situated at spatially diverse locations to provide microphone signals, a spatial filter coupled to the microphones, the spatial filter configured to spatially filter the microphone signals, a noise suppressor coupled to the spatial filter, the noise suppressor for suppressing noise, and an audio amplifier, the audio amplifier coupled to the noise suppressor, the audio amplifier for amplifying an audible output signal. In accordance with at least one embodiment, the noise suppressor comprises a voice activity detector coupled to the spatial filter, the voice activity detector for detecting voice activity and for selecting an updated spatial parameter value for the spatial filter to use for performing further spatial filtering.

18 Claims, 8 Drawing Sheets

HEARING ENHANCEMENT SYSTEM AND METHOD

CROSS-REFERENCE TO RELATED APPLICATIONS

This application claims the benefit of U.S. Provisional Application No. 62/593,442, filed Dec. 1, 2017, which is incorporated in its entirety herein by reference.

BACKGROUND

Field of the Disclosure

This disclosure relates generally to systems and methods for processing sound to be heard and more particularly to systems and methods for enhancing hearing.

Background of the Disclosure

Ideally, a listener is provided with a desired sound in absence of noise, and the listener's hearing provides a perfectly accurate perception of the desired sound to the listener. In reality, however, noise abounds and a listener's hearing can be impaired. Passive and active techniques, such as passive ear plugs and active noise cancellation (ANC), have been used to attempt to reduce noise, but they generally do not selectively enhance desired sounds while reducing noise. Thus, efforts to hear desired sounds have constrained noise reduction, and efforts to reduce noise have constrained the ability to hear desired sounds.

BRIEF DESCRIPTION OF THE DRAWINGS

The present disclosure may be better understood, and its numerous features and advantages made apparent to those skilled in the art by referencing the accompanying drawings.

The use of the same reference symbols in different drawings indicates similar or identical items.

DETAILED DESCRIPTION OF THE DRAWINGS

A system and method for selectively enhancing a desired sound while suppressing noise is provided. In accordance with at least one embodiment, the system and method can be implemented a variety of devices, such as hearing protection (e.g., ear plugs, ear muffs, and the like), hearing aids, communications headsets, earphones, etc. In accordance with at least one embodiment, a spatial filter can selectively enhance a desired sound based on a spatial relationship of its source to the system. In accordance with at least one embodiment, an artificial neural network (ANN) can implement deep learning to learn characteristics of noise, which can be used to suppress the noise while providing the desired sound to a user. In accordance with at least one embodiment, the system or method can be instantiated, for example, in an apparatus.

Figure 1:
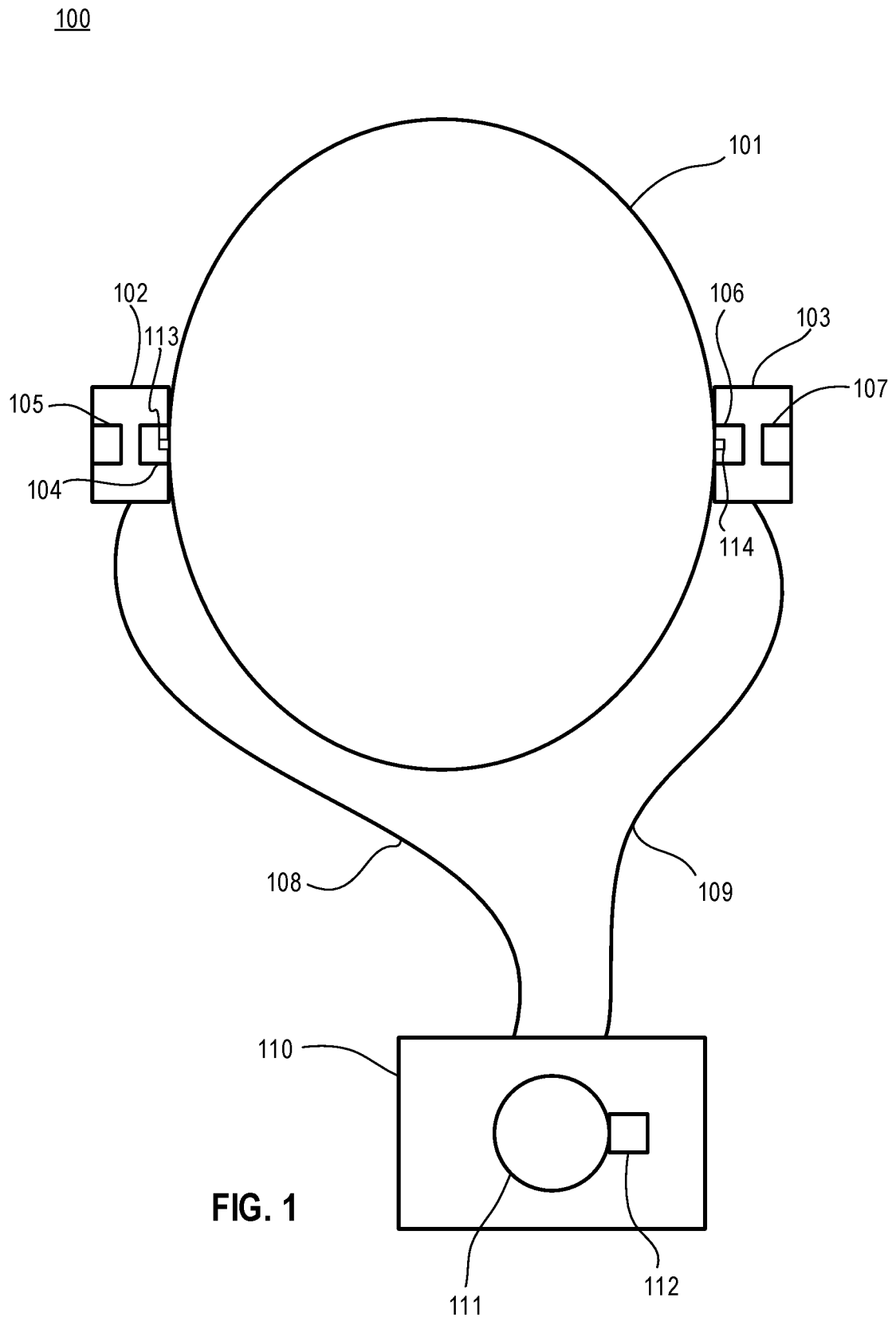
FIG. 1 is an elevation view diagram illustrating a system in accordance with at least one embodiment.

FIG. 1 is an elevation view diagram illustrating a system in accordance with at least one embodiment. System 100 comprises earpiece 102, earpiece 103, and control unit 110. Control unit 110 may be separate from earpieces 102 and 103, combined with one of earpieces 102 or 103, integrated into a unitized assembly with earpieces 102 and 103, or may be physically instantiated in another form factor. In an embodiment where control unit 110 is separate from earpieces 102 and 103, control unit 110 can be connected to earpiece 102 via cable 108 and to earpiece 103 via cable 109. In accordance with at least one embodiment, control unit 110 can be connected to earpieces 102 and 103 wirelessly (e.g., via a radio-frequency (RF), magnetic, electric, or optical link). In accordance with at least one embodiment, earpiece 102 can be connected to earpiece 103 wirelessly (e.g., via a RF, magnetic, electric, or optical link).

Earpiece 102 comprises speaker element 104. Earpiece 103 comprises speaker element 106. In accordance with at least one embodiment, earpiece 102 comprises external microphone 105, and earpiece 103 comprises external microphone 107. External microphones 105 and 107 can convert ambient acoustic signals incident to diverse points on a body of user 101 to respective electrical signals. As an example, external microphone 105 can convert an ambient acoustic signal incident to a right side of a head of user 101 to a right channel electrical signal, and external microphone 107 can convert an ambient acoustic signal incident to a left side of a head of user 101 to a left channel electrical signal. In accordance with at least one embodiment, earpiece 102 comprises internal microphone 113, and earpiece 103 comprises internal microphone 114. Internal microphone 113 can monitor an audible output of speaker element 104, and internal microphone 114 can monitor an audible output of speaker element 106. Internal microphones 113 and 114 can also monitor any other sound that may be present at or in the ear of user 101, such as any sound leakage past an occlusive ear plug seal or similar. Accordingly, internal microphones 113 and 114 can monitor the superposition of any sounds present in or at the ears, respectively, of user 101.

As one example, internal microphones 113 and 114 can be used to limit a gain of an audio amplifier to assure that a sound pressure level in the ear canals of user 101 does not exceed a safe level. As another example, internal microphones 113 and 114 can detect leakage of ambient sound into the ear canal, such as with occlusive ear plugs that are not properly sealed to the ear canals. A warning can be issued to user 101 of the improper sealing, such as an audible warning provided to speaker elements 104 and 106 or a visual or tactile warning provided via control unit 110.

In accordance with at least one embodiment, control unit 110 comprises a human interface device (HID) to allow control of system 100 by user 101. As an example, the HID comprises a first knob 111 that may be rotated relative to a housing of control unit 110. In accordance with at least one embodiment, the HID comprises a second knob 112 mounted on first knob 111. In accordance with at least one embodiment, second knob 112 has a second knob axis at an angle to a first knob axis of first knob 111. In accordance with at least one embodiment, the first knob can be used to control an angular direction for spatial filtering, and the second knob can be used to control an amount of spatial filtering. As an example, the amount of spatial filtering may include a positive amount and a negative amount. For example, the range of spatial filtering may include a portion of the range where spatial filtering provides an increased amount of sensitivity (e.g., a peak) in a designated direction and a portion of the range where spatial filtering provides a reduced amount of sensitivity (e.g., a null) in the designated direction. In accordance with such an example, sensitivity can be focused in a particular direction (e.g., toward a person speaking) by increasing the sensitivity in the direction of the person speaking, or a noise source in a particular direction can be blocked by reducing the sensitivity in the direction of the noise source. In accordance with at least one embodiment, another type of HID (e.g., a joystick, pointer stick, track ball, touchpad, mouse, another type of HID, or a combination thereof) can be used to provide filtering and noise suppression control values to system 100.

Figure 2:
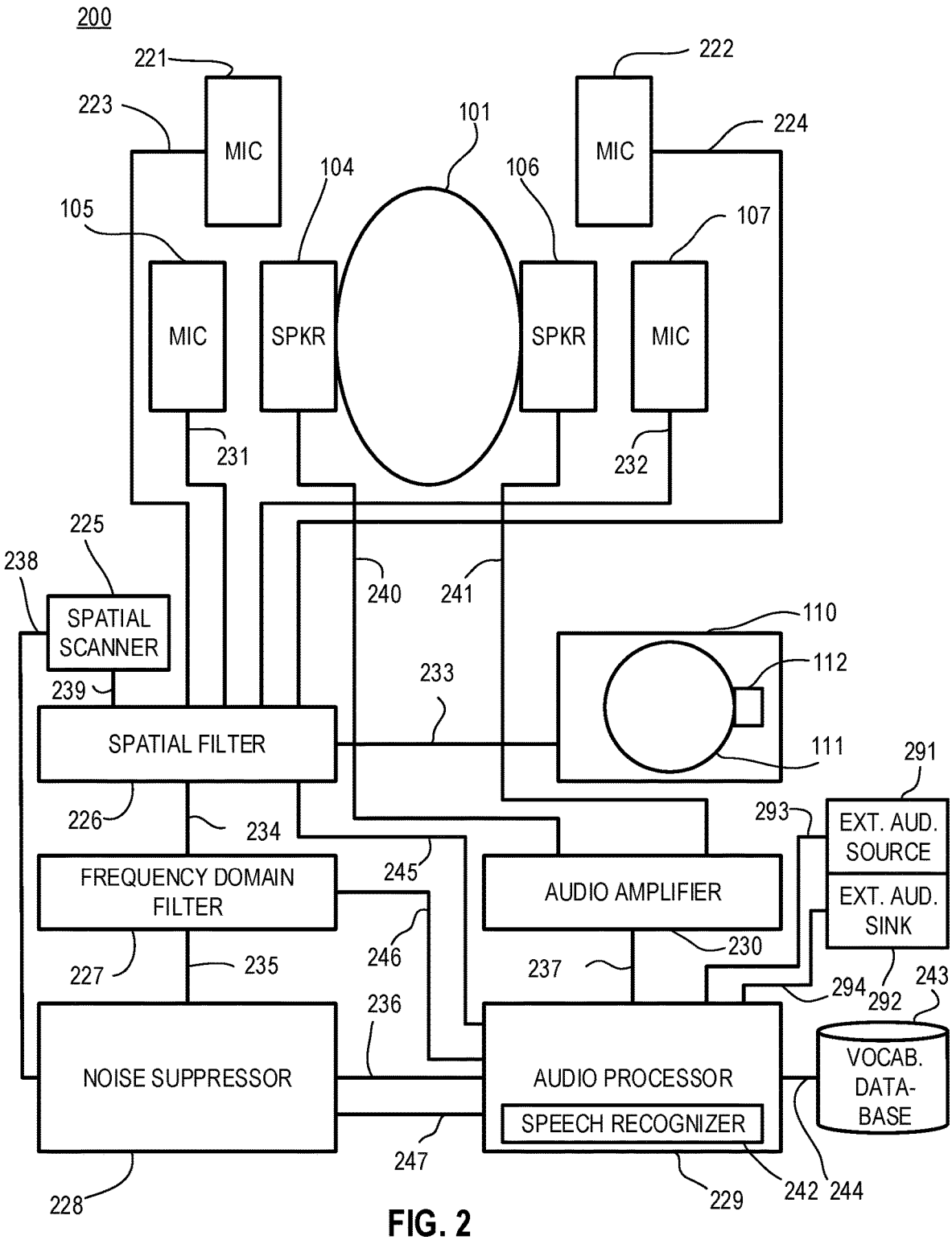
FIG. 2 is a block diagram illustrating a system in accordance with at least one embodiment.

FIG. 2 is a block diagram illustrating a system in accordance with at least one embodiment. System 200 comprises speaker elements 104 and 106, microphones 105, 107, 221, and 222, spatial scanner 225, spatial filter 226, control unit 110, frequency domain filter 227, noise suppressor 228, audio processor 229, vocabulary database 243, and audio amplifier 230. As in FIG. 1, speaker elements 104 and 106 can be situated to provide audible output, respectively, to ears of user 101. For example, speaker elements 104 and 106 may be situated in or adjacent to ears of a user 101, or sound from speaker elements 104 and 106 can be ducted, for example, using tubes, to the respective ears from speaker elements 104 and 106 located elsewhere. Microphone 105 can be an external microphone located near (but acoustically isolated from) speaker element 104. Microphone 107 can be an external microphone located near (but acoustically isolated from) speaker element 106. Microphones 221 and 222 can be situated at spatially diverse locations in relation to user 101. As an example, microphones 221 and 222 can be situated toward a back of the head of user 101 or in other locations to provide spatial diversity about an axis of user 101.

Microphone 105 is coupled to spatial filter 226 via interconnect 231. Microphone 107 is coupled to spatial filter 226 via interconnect 232. Microphone 221 is coupled to spatial filter 226 via interconnect 223. Microphone 222 is coupled to spatial filter 226 via interconnect 224. Microphones 105, 107, 221, and 222 convert acoustic signals to electrical signals and provide those electrical signals to spatial filter 226.

Spatial filter 226 provides an ability to adjust the sensitivity of microphones of a microphone array (e.g., microphones 105, 107, 221, and 222) on a spatial basis (e.g., as a function of a direction with respect to user 101). Control unit 110 is coupled to spatial filter 226 via interconnect 233. In the illustrated example, control unit 110 comprises first knob 111 and second knob 112. Spatial filter 226 is coupled to frequency domain filter 227 via interconnect 234.

Frequency domain filter 227 provides spectral filtering, which can increase or decrease spectral content across various frequencies. For example, if speech frequencies are known or can be approximated (e.g., by selecting a pass band of 300 to 3000 Hertz (Hz)), spectral filtering by frequency domain filter 227 can serve to distinguish speech from noise, as the spectral content of the noise may be outside of the pass band or may extend outside of the pass band. Frequency domain filter 227 provides its spectrally filtered output signal to noise suppressor 228 via interconnect 235.

Noise suppressor 228 distinguishes a desired signal, such as speech, from noise based on different characteristics of the desired signal relative to characteristics of the noise. As an example, noise suppressor 228 can use an artificial neural network (ANN) to learn the characteristics of the noise and, upon detection of occurrence of a desired signal, to subtract the noise from the incoming signal to yield a close approximation of the desired signal with the accompanying noise substantially reduced or eliminated. Noise suppressor 228 provides its noise-suppressed output to audio processor 229 via interconnect 236.

Audio processor 229 provides processing of audio, for example, the noise-suppressed output received from noise suppressor 228. Audio processor 229 can be coupled to an external audio source 291 via interconnect 293. Audio processor 229 can receive an external audio signal from external audio source 291, such as a received audio signal from a radio or a telephone. Audio processor 229 can be coupled to an external audio sink 292 via interconnect 294. Audio processor 229 can provide an audio signal to external audio sink 292, which may, for example, be a recorder, such as a recording body camera (bodycam).

Audio processor 229 can comprise a speech recognizer 242, such as one providing speaker-independent speech recognition. Audio processor 229 can be coupled to vocabulary database 243 via interconnect 244. Speech recognizer 242 can attempt to match patterns of audio to representations of words stored in vocabulary database 243. Based on the incidence of matching, speech recognizer 242 can assess the intelligibility of the audio. Based on the assessment of the intelligibility of the audio, audio processor 229 can provide feedback control signals to one or more of spatial filter 226, frequency domain filter 227, and noise suppressor 228 via interconnects 245, 246, and 247, respectively, as audio processor 229 is coupled to spatial filter 226 via interconnect 245, to frequency domain filter 227 via interconnect 246, and to noise suppressor 228 via interconnect 247.

It should be noted that vocabulary database 224 can contain a greatly reduced (e.g., sparse) set of representations of words. For example, vocabulary database 224 need not contain nouns, verbs, adjectives, and adverbs, but may contain more frequently used words, for example, articles, pronouns, prepositions, conjunctions, and the like. Alternatively, vocabulary database 224 may be expanded to include a larger vocabulary, which may include additional parts of speech. Audio processor 229 provides its processed audio output to audio amplifier 230 via interconnect 237.

In accordance with at least one embodiment, speech recognizer 242 may be replaced or supplemented with a coder-decoder (codec) or a voice coder (vocoder). The codec or vocoder can recognize features of speech. As an example, by qualifying a voice activity detection indication of noise suppressor 228 by a quality of codec or vocoder output, an intelligibility of noise-suppressed audio can be estimated. The intelligibility estimate may be used to provide a spatial filter feedback signal to control operation of spatial filter 226, a frequency domain filter feedback signal to control operation of frequency domain filter 227, and a noise suppressor feedback signal to control operation of noise suppressor 228.

In accordance with at least one embodiment, additional user controls may be provided to allow a user 101 to adjust system characteristics, for example, to accommodate a hearing impairment of the user 101. As an example, if a user has a hearing impairment that results in distorted perceived speech, the additional user controls may be used to introduce pre-distortion, such as an inverse function of the distortion user 101 experiences. The pre-distortion parameters can be saved in system 200 and applied to sounds, such that the subsequent distortion user 101 experiences can effectively invert the pre-distortion to yield a relatively distortion-free perceived sound for user 101. Any additional alteration of the audible output of the system, as may result, for example, from non-idealities of speaker elements 104 and 106 or from interaction of speaker elements 104 and 106 with their respective ear canals, can be quantified and characterized by making measurements using internal microphones 113 and 114, respectively. Accordingly, characterization based on sound as received by internal microphones can promote repeatability of the effect, as perceived by user 101, of the pre-distortion and, thus, repeatability of the inversion of the distortion and correction of the distorted perceived speech.

Audio amplifier 230 amplifies the processed audio output from audio processor 229 and provides an amplified audio output to speaker element 104 via interconnect 240 and to speaker element 106 via interconnect 241. The amplified audio output may be a single common amplified audio output for both speaker elements 104 and 106 or may be separate amplified audio outputs, one for speaker element 104 and another for speaker element 106.

Information obtained from spatial filter 226 may be provided to audio processor 229 to allow audio processor 229 to incorporate spatially meaningful components into processed audio outputs provided by audio processor 229 to allow user 101 to perceive spatial relationships from the audible signals provided by speaker elements 104 and 106 to the ears of user 101. As an example, if spatial filter 226 locate a sound as coming from a direction of microphone 105 relative to the head of user 101, spatial filter 226 can provide spatial information to audio processor 229 to cause audio processor 229 to provide a processed audio output via audio amplifier 230 to speaker element 104 to make user 101 perceive the sound is coming from the direction of speaker element 104, which is aligned with the direction of microphone 105. Spatial filter 226 and audio processor 229 can interpolate spatial information for sounds coming from sources angularly between multiple microphones to provide an interpolated perception at an angle that need not be on axis with the ears of user 101.

In accordance with at least one embodiment, audio processor 229 may implement a head related transfer function (HRTF) to incorporate spatial information into the processed audio outputs, allowing user 101 to perceive a source of the audible signals as being at a designated location within three-dimensional space surrounding user 101. The HRTF may be used to alter the amplitude and phase over various frequencies of the audio signals being processed to simulate the amplitude and phase changes that would occur at anatomical features of user 101, such as the folds of the ears, the binaural phase differences between the ears, diffraction around the head, and reflection off the shoulders and torso of user 101 when exposed to sounds originating in spatial relationship to user 101.

In accordance with at least one embodiment, an automatic spatial filtering capability can be implemented. The automatic spatial filtering capability can be implemented without the manual input of a HID or in conjunction with manual input provided from a HID. To implement the automatic spatial filtering capability, the system can comprise spatial scanner 225. Spatial scanner 225 can scan multiple values of spatial filter parameters serially, in parallel, or in a combination of serial and parallel operation. As an example, spatial scanner can adjust spatial filter parameters of spatial filter 226 to direct the sensitivity of the system in different directions relative to user 101. As the results of the spatial filtering are applied to frequency domain filter 227 and then to noise suppressor 228, a portion of noise suppressor 228, such as a voice activity detector, can detect voice activity. A measure of the level of detected voice activity can be provided to spatial scanner 225 via interconnect 238. Spatial scanner 225 can compare the measures of the levels of detected voice activity over multiple spatial filter parameter values to identify a highest measure of detected voice activity and, thus, to identify a set of spatial filter parameter values corresponding to the highest measure of detected voice activity. From the identified set of spatial filter parameter values, spatial scanner 225 can spatially characterize the source of the detected voice activity.

The ability to spatially characterize the source of the detected voice activity allows spatial scanner 225 to configure spatial filter 226 to spatially reject noise coming from directions relative to user 101 other than the direction in which the source of the detected voice activity is spatially characterized. The noise rejection provided by the properly configured spatial filter 226 minimizes the noise applied to noise suppressor 228, increasing the performance of noise suppressor 228. The automatically determined spatial information obtained by the operation of spatial scanner 225 allows audio processor 229 to adjust the audio it is processing and providing via audio amplifier 230 to speaker elements 104 and 106 so as to impress upon user 101 a perception of spatial tracking of the location of the source of the signal being processed. Thus, for example, if a speaker is to the left of user 101, spatial scanner 225 can effectively focus spatial filter 226 to increase sensitivity of system 100 toward the left of user 101 while reducing sensitivity of system 100 in directions other than to the left of user 101, thereby minimizing the influence of noise originating in directions other than to the left user 101. Noise suppressor 228 can then further reduce or eliminate any remaining noise. Spatial filter parameter values descriptive of a source to the left of user 101 can be provided by the operation of spatial scanner 225 and spatial filter 226 to audio processor 229. Audio processor 229 can use the spatial filter parameter values to process the audio provided to speaker elements 104 and 106 via audio amplifier 230 to impress upon user 101 that the source of the sound is to the left of user 101.

In accordance with at least one embodiment, multiple instances of elements of system 200 allow for simultaneous operation according to multiple values of spatial filtering parameters, for example, under control of spatial scanner 225. As one example, two instances of each of spatial filter 226, frequency domain filter 227, and noise suppressor 228 are provided. While one instance of such elements processes signals according to a best set of values of spatial filtering parameters, as determined, for example, by spatial scanner 225, to provide processed audio output to speaker elements 104 and 106, the other instance of such elements can be used by spatial scanner 225 to scan over a range of spatial filtering parameter values to update the best set of values. Accordingly, the first instance can effectively focus on a perceived source of sound, while the second instance searches spatially for a better estimation of the location of the source of sound or of another source of sound. Thus, system 200 can spatially track a moving source of sound and switch between different sources of sound, such as different speakers at different locations, as well as statically focusing on a fixed sound source. In the event that a voice activity detector of noise suppressor 228 does not detect voice activity, the instance of elements including such voice activity detector can be released to spatial scanner 225 for scanning over the range of spatial filtering parameter values. Thus, for the two-instance example, when no voice activity is detected by either instance, both instances can be used for spatial scanning, which can increase the speed with which system 200 can localize a sound source. Other implementations can be provided with more than two instances, or a single instance can lock onto a sound source location for the duration of voice activity detection and can be released to spatial scanner 225 to allow scanning over a range of spatial filtering parameter values when no voice activity is detected.

Figure 3:
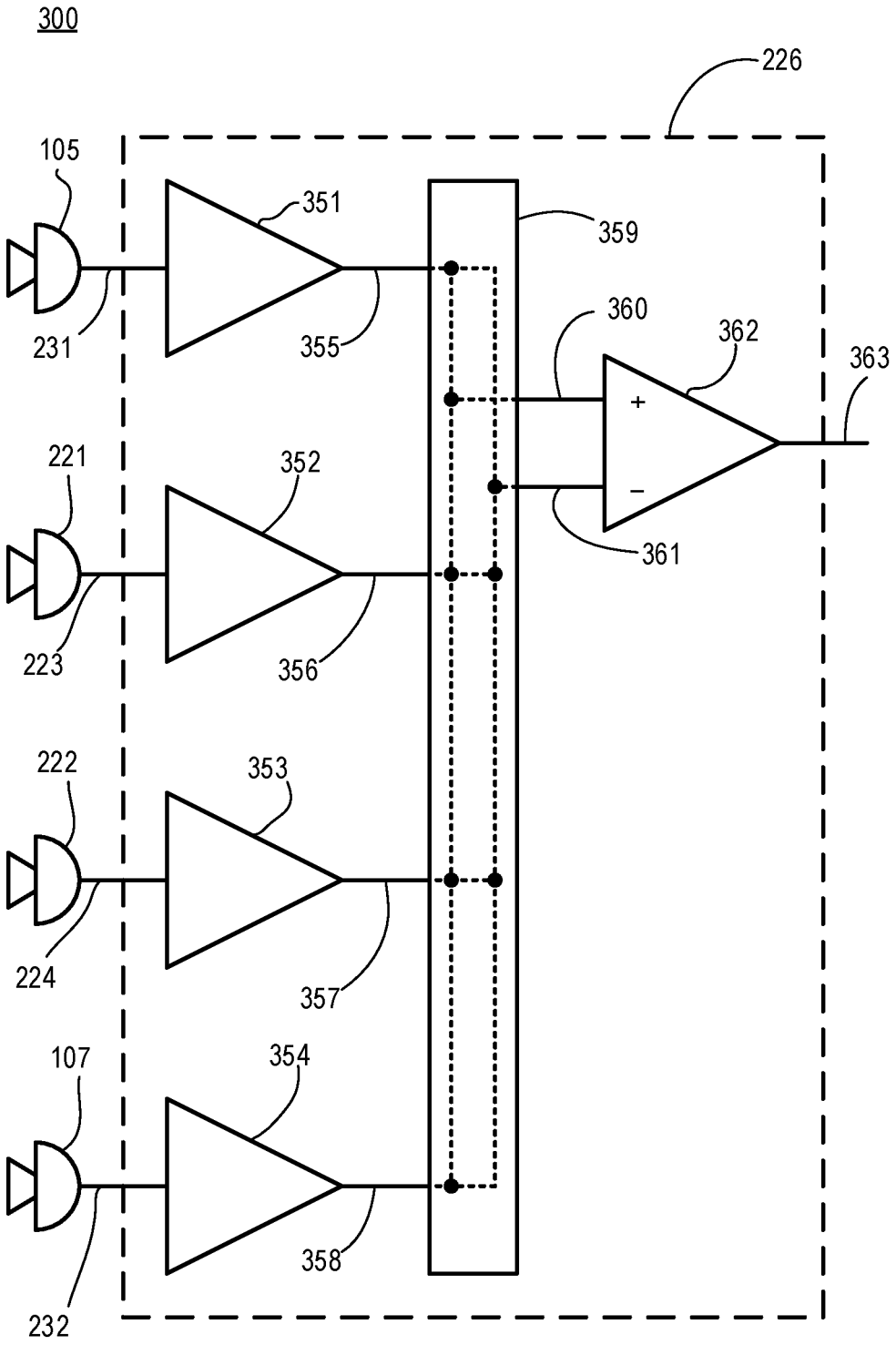
FIG. 3 is a schematic diagram illustrating a spatial filter in accordance with at least one embodiment.

FIG. 3 is a schematic diagram illustrating a spatial filter in accordance with at least one embodiment. In accordance with at least one embodiment, spatial filter 226 comprises microphone preamplifier 351, microphone preamplifier 352, microphone preamplifier 353, microphone preamplifier 354, interconnection network 359, and differential amplifier 362. Microphone 105 is coupled, via interconnection 231, to an input of microphone preamplifier 351. Microphone preamplifier 351 is connected to interconnection network 359 via interconnection 355. Microphone 221 is coupled, via interconnection 223, to an input of microphone preamplifier 352. Microphone preamplifier 352 is connected to interconnection network 359 via interconnection 356. Microphone 222 is coupled, via interconnection 224, to an input of microphone preamplifier 353. Microphone preamplifier 353 is connected to interconnection network 359 via interconnection 357. Microphone 107 is coupled, via interconnection 232, to an input of microphone preamplifier 354. Microphone preamplifier 354 is connected to interconnection network 359 via interconnection 358.

Interconnection network 359 is configurable to control the application of the signals from microphones 105, 221, 222, and 107 to the non-inverting input of differential amplifier 362 via interconnection 360, to the inverting input of differential amplifier 362 via interconnection 361, or, in some proportion, to both the non-inverting input and the inverting input of differential amplifier 362. As an example, assuming equal sensitivities of microphones 105, 221, 222, and 107 and equal gains of microphone preamplifiers 351, 352, 353, and 354, to focus spatial filter subsystem 300 for maximum sensitivity in the direction of microphone 105 while rejecting noise from other directions, interconnection network 359 can be configured to apply the signal from microphone 105 to the non-inverting input of differential amplifier 362 and to apply a one-third proportion of the signals of each of microphones 221, 222, and 107 to the inverting input of differential amplifier 362. Since ambient noise tends to be received substantially equally by microphones of different locations and orientations, while a reasonably focal source of sound, especially at a relatively short distance, tends to be received more effectively by a proximate microphone, ambient noise received by microphones 105, 221, 222, and 107 tends to be cancelled out by application to the non-inverting input and inverting input of differential amplifier 362, and sound from the direction of microphone 105 tends not to be cancelled out by its application to the non-inverting input of differential amplifier 362 in absence of appreciable application to the inverting input of differential amplifier 362. As one example of a differential amplifier, an operational amplifier (op amp) may be used to implement a differential amplifier. Differential amplifier 362 provides an output signal at interconnection 363.

While spatial filter subsystem 300 is illustrated with an exemplary single differential amplifier 362, embodiments of spatial filter subsystem 300 may be implemented using multiple differential amplifiers. As an example, a network of differential amplifiers may be provided with each differential amplifier comparing the signals obtained from two microphones. For example, a first differential amplifier may amplify a difference of the amplitudes of the signals of microphones 105 and 221, a second differential amplifier may amplify a difference of the amplitudes of the signals of microphones 105 and 222, a third differential amplifier may amplify a difference of the amplitudes of the signals of microphones 105 and 107, a fourth differential amplifier may amplify a difference of the amplitudes of the signals of microphones 221 and 222, a fifth differential amplifier may amplify a difference of the amplitudes of the signals of microphones 221 and 107, and a sixth differential amplifier may amplify a difference of the amplitudes of the signals of microphones 222 and 107. The outputs of the differential amplifiers can be compared to identify the differential amplifier having the greatest output level, and the output signal of that differential amplifier can be provided for further processing, for example by frequency domain filter 227, noise suppressor 228, and audio processor 229.

While the description of spatial filter subsystem 300 above is provided which respect to an exemplary analog circuit implementation, spatial filter subsystem 300 can be implemented using digital circuitry or a combination of analog and digital circuitry. As an example, the signals from the microphones of the microphone array (e.g., microphones 105, 221, 222, and 107) can be digitized using one or more analog-to-digital converters (ADCs), and the digital representations of those signals can be processed. For example, amplitudes of the digital representations can be compared and subtracted digitally to implement the functionality of the illustrated differential amplifier or the described multiple differential amplifiers.

While amplitude differences among the signals received at spatially diverse microphones may be greater for sound sources in closer proximity to spatial filter subsystem 300, providing directionality of the microphone array at closer distances using one or more differential amplifiers, such as differential amplifier 362, directionality of the microphone array can also be provided for sound sources more distal to spatial filter subsystem 300. As one example, a time difference of arrival (TDOA) technique, such as multilateration, may be implemented. For example, a time delay element may be provided for one or more of the microphones of the microphone array to allow adjustment of the timing of the arrival of the signals at a comparison or subtraction element, such as differential amplifier 362. In the illustrated example, a first adjustable time delay element may be provided between microphone preamplifier 351 and interconnection network 359, a second adjustable time delay element may be provided between microphone preamplifier 352 and interconnection network 359, a third adjustable time delay element may be provided between microphone preamplifier 353 and interconnection network 359, and a fourth adjustable time delay element may be provided between microphone preamplifier 354 and interconnection network 359. The adjustable delay elements may be configured to cooperate so as to function as a delay-and-sum beamformer, such as a weighted delay-and-sum beamformer.

While a range of possible time delay values for each of several microphone signals yields a large number of possible combinations of possible time delay values, a successive approximation approach may be implemented to efficiently provide multilateration. As an example, a time delay value for a first microphone may be held constant while a time delay value for a second microphone may be adjusted over its range to identify the timing relationship between the first and second microphones that yields the greatest response (e.g., the greatest voice activity detection level of noise suppressor 228). Once that timing relationship is determined, a signal from a third microphone can be included, and the time delay value for the third microphone may be adjusted over its range to identify the timing relationship between the first, second, and third microphones that yields the greatest response. Additional microphone signals can be successively included. For example, a signal from a fourth microphone can be included, and the time delay for the fourth microphone may be adjusted over its range to identify the timing relationship between the first, second, third, and fourth microphones that yields the greatest response. The timing relationship can be adjusted dynamically, for example, by continuing to adjust one or more time delay values over time, or a parallel channel of processing elements, such as a second instance of each of spatial filter 226, frequency domain filter 227, and noise suppressor 228 may be provided for tentative adjustment of the timing relationship dynamically. Then, once an optimal updated timing relationship is determined empirically using the second instance of the elements, a first instance of the elements being used for providing output to speaker elements 104 and 106 may be updated to use the optimal updated timing relationship determined using the second instance of the elements.

A digital implementation of a TDOA (e.g., multilateration) feature of spatial filter subsystem 300 may be provided, for example, by time shifting samples in digital representations of microphone signals from microphones of a microphone array. As such calculations can be performed very rapidly by modern processor cores, an optimal updated timing relationship can be calculated very quickly, even for microphone arrays with many microphones.

Figure 4:
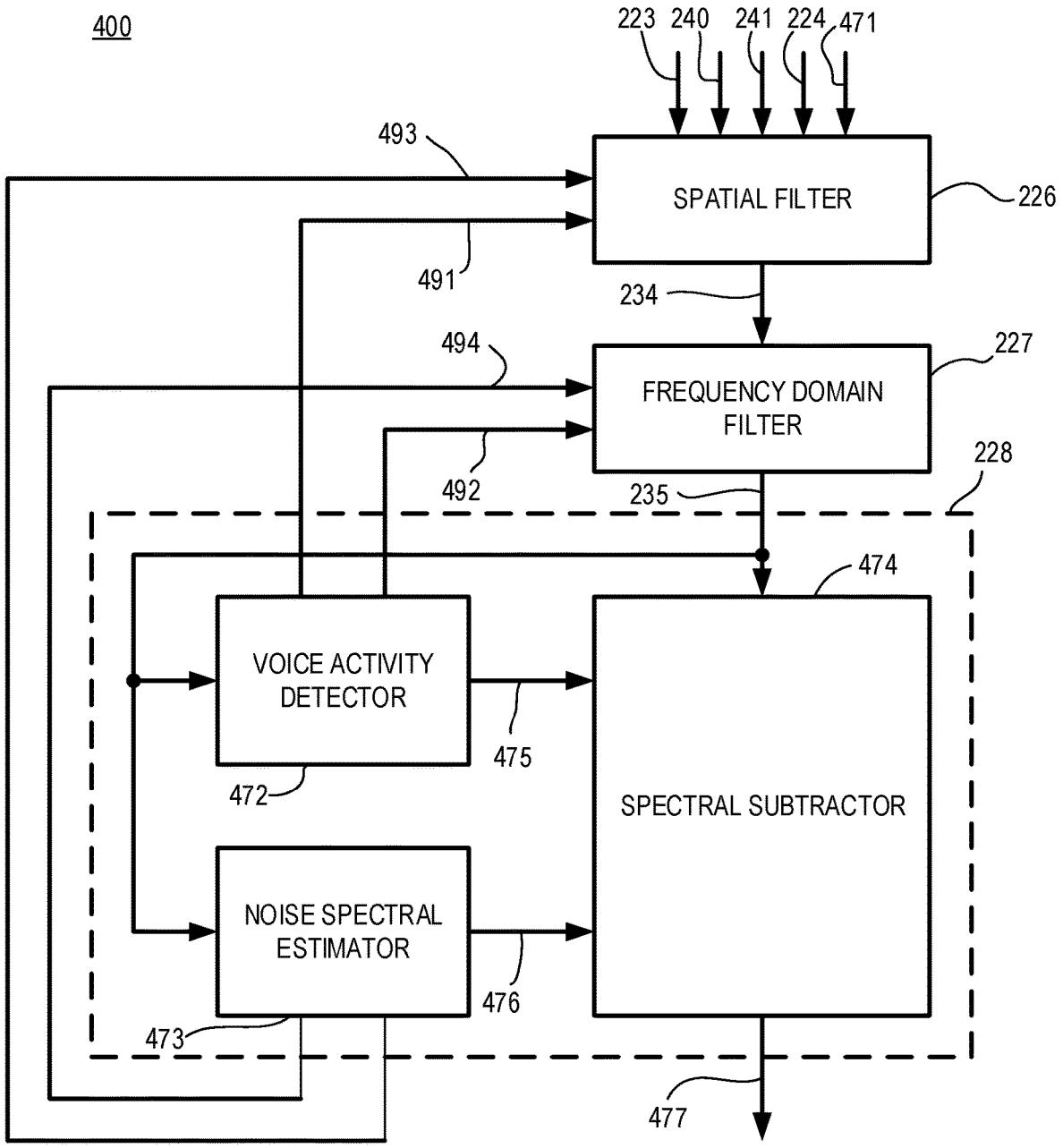
FIG. 4 is a block diagram illustrating a noise suppressor in accordance with at least one embodiment.

FIG. 4 is a block diagram illustrating a noise suppressor in accordance with at least one embodiment. Noise suppressor subsystem 400 comprises spatial filter 226, frequency domain filter 227, and noise suppressor 228. In accordance with at least one embodiment, noise suppressor 228 comprises voice activity detector 472, noise spectral estimator 473, and spectral subtractor 474. In accordance with at least one embodiment, after spatial filtering by spatial filter 226 and spectral filtering by frequency domain filter 227, a signal is provided to noise suppressor 228 for noise suppression to be performed. In accordance with at least one embodiment, noise suppressor 228 implements an ANN to provide deep learning of the characteristics of noise present in the signal, allowing the noise to be filtered from the signal, maximizing the intelligibility of the resulting noise-suppressed signal.

Interconnects 223, 240, 241, 224, and 471 are coupled to spatial filter 226 and provide signals obtained from microphones to spatial filter 226. Spatial filter 226 provides spatial filtering and provides a spatially filtered output signal to frequency domain filter 227 via interconnect 234. Frequency domain filter 227 provides spectral filtering and provides a spectrally filtered output signal to voice activity detector 472, noise spectral estimator 473, and spectral subtractor 474 of noise suppressor 228 via interconnect 235. Voice activity detector 472 detects voice activity and provides an indication of voice activity to spectral subtractor 474 via interconnect 475. Noise spectral estimator 473 estimates the spectral characteristics of the noise present in the incoming signal (e.g., the spectrally filtered output signal from spectral filter 226) and provides the noise spectral estimate to spectral subtractor 474 via interconnect 476. When voice activity detector 472 detects voice activity, spectral subtractor 474 subtracts the spectral noise estimate obtained by noise spectral estimator 473 from the incoming signal to yield a noise-suppressed signal at interconnect 477.

In accordance with at least one embodiment, an ANN of noise suppressor subsystem 400 can be implemented using a recurrent neural network (RNN). As an example, a RNN can use gated units, such as long short-term memory (LSTM), gated recurrent units (GRUs), the like, or combinations thereof. In accordance with at least one embodiment, the incoming signal can be binned into a plurality of frequency bands, such as bands selected according to the Bark scale, a perceptually based plurality of frequency bands spanning the audible spectrum. The ANN can be used to adjust the gain for each band of the plurality of bands in response to the noise present in the incoming signal to attenuate the noise in a real-time manner yet to allow the desired signal, which the ANN does not characterize as noise, to be passed. As an example, the ANN can provide a noise spectral estimate at noise spectral estimator 473 in the form of individual noise spectral estimates for each of the frequency bands. Spectral subtractor 474 can subtract the amplitude of the individual noise spectral estimates from the amplitude of the incoming signal on a per-frequency-band basis to yield a noise-suppressed signal. Spectral subtractor 474 can adjust the gain for each of the frequency bands in response to the individual noise spectral estimates for the respective frequency bands provided by noise spectral estimator 473.

In accordance with at least one embodiment, harmonic content of speech can be preserved by using the harmonic richness of speech to distinguish speech from noise and to maximize intelligibility of the noise-suppressed signal. As an example, a multi-band excitation (MBE) technique can be implemented. A fundamental frequency of an element of speech can be identified, and harmonic frequencies within the audible spectrum (e.g., within a voice pass band) can be extrapolated from the fundamental frequency. Energy in the incoming signal at the fundamental frequency and the harmonic frequencies can be allowed to pass through noise suppressor subsystem 400, while other frequencies can be attenuated by noise suppressor subsystem 400. As an example, a comb filter can be implemented to pass the fundamental frequency and the harmonic frequencies while rejecting the other frequencies.

Noise suppressor 228 can be implemented using an existing noise suppressor, such as the speexdsp noise suppressor developed by Jean-Marc Valin or the RNNoise noise suppressor also developed by Jean-Marc Valin. In accordance with at least one embodiment, the noise suppressor is not treated as a stand-alone element operating in relative isolation; rather, voice activity detector 472 not only provides a voice activity detection indication to spectral subtractor 474, but also provides a feedback signal to spatial filter 226 via interconnect 491 and a feedback signal to frequency domain filter 227 via interconnect 492, and noise spectral estimator 473 not only provides a noise spectral estimate to spectral subtractor 474 via interconnect 476, but also provides a feedback signal to spatial filter 226 via interconnect 493 and a feedback signal to frequency domain filter 227 via interconnect 494. As an example, a qualitative feedback signal from voice activity detector 472 to spatial filter 226 can provide spatial filter 226 with an indication of voice activity detection that can be used by spatial filter 226 to adaptively tune spatial filter 226 for optimal system performance. As an example, a qualitative feedback signal from voice activity detector 472 to frequency domain filter 227 can provide frequency domain filter 227 with an indication of voice activity detection that can be used by frequency domain filter 227 to adaptively tune frequency domain filter 227 for optimal system performance. As an example, a quantitative feedback signal from voice activity detector 472 to spatial filter can be used by spatial filter 226 to adaptively tune spatial filter 226 in accordance with a quantitative value of the quantitative feedback signal. As an example, a quantitative feedback signal from voice activity detector 472 to frequency domain filter 227 can be used by frequency domain filter 227 to adaptively tune frequency domain filter 227 in accordance with a quantitative value of the quantitative feedback signal. As an example, a qualitative feedback signal from noise spectral estimator 473 to spatial filter 226 can provide spatial filter 226 with an indication of estimated noise that can be used by spatial filter 226 to adaptively tune spatial filter 226 for optimal system performance. As an example, a qualitative feedback signal from noise spectral estimator 473 to frequency domain filter 227 can provide frequency domain filter 227 with an indication of estimated noise that can be used to adaptively tune frequency domain filter 227 for optimal system performance. As an example, a quantitative feedback signal from noise spectral estimator 473 to spatial filter can be used by spatial filter 226 to adaptively tune spatial filter 226 in accordance with a quantitative value of the quantitative feedback signal. As an example, a quantitative feedback signal from noise spectral estimator 473 to frequency domain filter 227 can be used by frequency domain filter 227 to adaptively tune frequency domain filter 227 in accordance with a quantitative value of the quantitative feedback signal.

Figure 5:
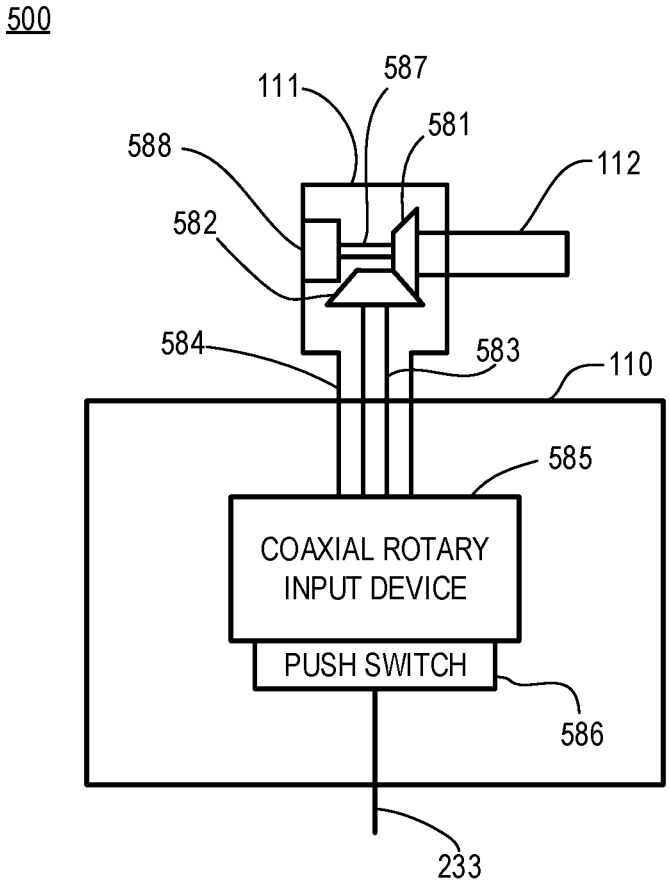
FIG. 5 is a cross-sectional elevational view diagram illustrating a human interface device in accordance with at least one embodiment.

FIG. 5 is a cross-sectional elevational view diagram illustrating a human interface device in accordance with at least one embodiment. Human interface device subsystem 500 comprises control unit 110, first knob 111, and second knob 112. An axis of second knob 112 is oriented at an angle (e.g., a right angle) to an axis of first knob 111. Second knob 112 is coupled to bevel gear 581, which is coaxial with second knob 112. Bevel gear 581 meshes with bevel gear 582, which is coaxial with first knob 111. Bevel gear 582 is coupled to coaxial shaft 583, which is an inner coaxial shaft coupled to coaxial rotary input device 585, which is coaxial with first knob 111. First knob 111 is coupled to coaxial shaft 584, which is an outer coaxial shaft coupled to coaxial rotary input device 585. Coaxial rotary input device obtains a measure of rotary displacement of coaxial shaft 584 and a measure of rotary displacement of coaxial shaft 583 and transmits the measure of rotary displacements of the coaxial shaft via interconnect 233.

When first knob 111 is rotated, coaxial rotary input device 585 can measure the rotary displacement of coaxial shaft 584 coupled to first knob 111. When second knob 112 is rotated, bevel gear 581 rotates, which rotates bevel gear 582, which rotates coaxial shaft 583. Coaxial rotary input device 585 can measure the rotary displacement of coaxial shaft 583 as second knob 112 is rotated. Any rotation of coaxial shaft 583 as a consequence of rotation of first knob 111 can be subtracted from the rotation of coaxial shaft 584 to yield a measure of the rotation of second knob 112 independent of any rotation of first knob 111. As an example, a digital rotary encoder, such an optical rotary encoder, may be used to implement coaxial rotary input device 585. As another example, a potentiometer may be used to implement coaxial rotary input device 585.

In accordance with at least one embodiment, a noise suppression defeat switch may be provided to allow user 101 to defeat the operation of noise suppressor 228, for example, to listen to ambient sounds. In accordance with at least one embodiment, a noise suppression defeat switch may be provided as a push function of either or both of first knob 111 and second knob 112. As an example, a shaft 587 can couple second knob 112 to a switch 588 contained within first knob 111. For example, bevel gear 581 may be slidably mounted on shaft 587, and a spring may be provided internal to bevel gear 581, surrounding shaft 587 as it passes through bevel gear 581, to bias against second knob 112 and bevel gear 581 to keep bevel gear 581 engaged with bevel gear 582. As another example, pushing on second knob 112 can cause bevel gears 581 and 582 to translate the displacement of second knob 112 into a displacement of coaxial shaft 583 along its axis. A push switch 586 can be coupled to coaxial shaft 583 to be actuated by the displacement of coaxial shaft 583. As yet another example, push switch can be coupled to coaxial shaft 584 to be actuated by displacement of coaxial shaft 584 when first knob 111 is depressed. As a further example, multiple instances of push switch 586 can be provided, for example, one coupled to coaxial shaft 583 and another coupled to coaxial shaft 584, allowing actuation of a respective first push switch and second push switch in response to depression of first knob 11 and second knob 112. Any of switch 588 and one or more of push switch 586 can transmit an indication of their actuation via interconnect 233. While one of the switches may be used to implement a noise suppression defeat switch, one or more other switches may be used to implement other functions, such as a parameter value save and recall function to save desired parameter values. For example, a long duration depression of a parameter value save and recall switch may save desired parameter values for future use, and a short duration depression of the parameter value save and recall switch may recall the desired parameter values to configure the system to use such desired parameter values.

Figure 6:
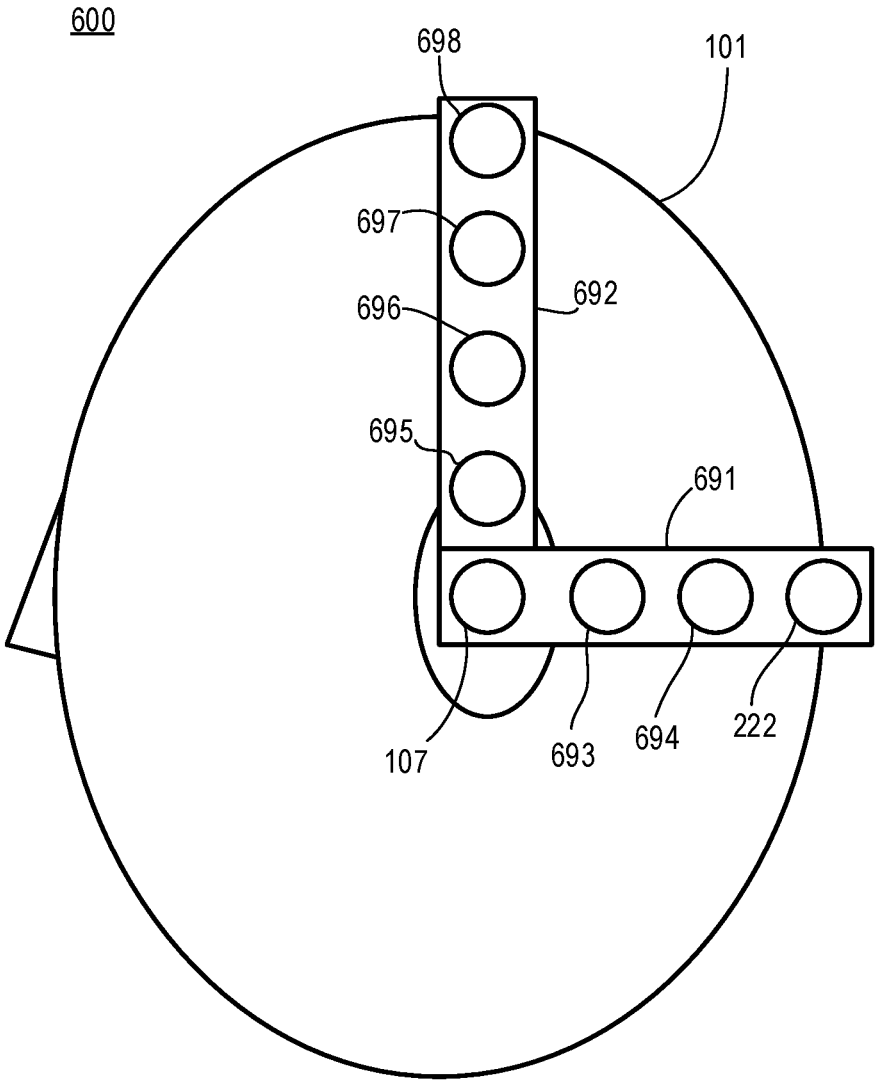
FIG. 6 is a left side elevation view illustrating a system in accordance with at least one embodiment.

FIG. 6 is a left side elevation view illustrating a system in accordance with at least one embodiment. System 600 comprises horizontal headband 691 and vertical headband 692, which may be worn by user 101. Horizontal headband 691 comprises microphones 107, 693, 694, and 222 at spatially diverse locations along horizontal headband 691. Vertical headband 692 comprises microphones 695, 696, 697, and 698 at spatially diverse locations along vertical headband 692. By providing a plurality of microphones that are situated in space beyond a single plane, such as a horizontal plane or a vertical plane, three-dimensional spatial filtering can be provided by spatial filter 226. While only the left side of system 600 is visible in FIG. 6, system 600 can extend to the right side of the head of user 101. As an example, a mirror image of the portion of system 600 depicted in FIG. 6 can be implemented on the right side of the head of user 101.

Spatial filtering can utilize the spatially diverse locations of the microphones of system 600 to selectively filter sound based on the location of the source of the sound. As an example, if a person speaks near the left ear of user 101, a proximate microphone, such as microphone 107, will provide a greater response (e.g., a signal of greater amplitude), while a distal microphone, such as microphone 698, will provide a lesser response (e.g., a signal of lesser amplitude). However, both the proximate microphone and the distal microphone will tend to provide approximately the same response to a more remotely located noise source. Thus, by using the techniques described herein, the speech of the person speaking can be enhanced, while the ambient noise can be rejected.

Figure 7:
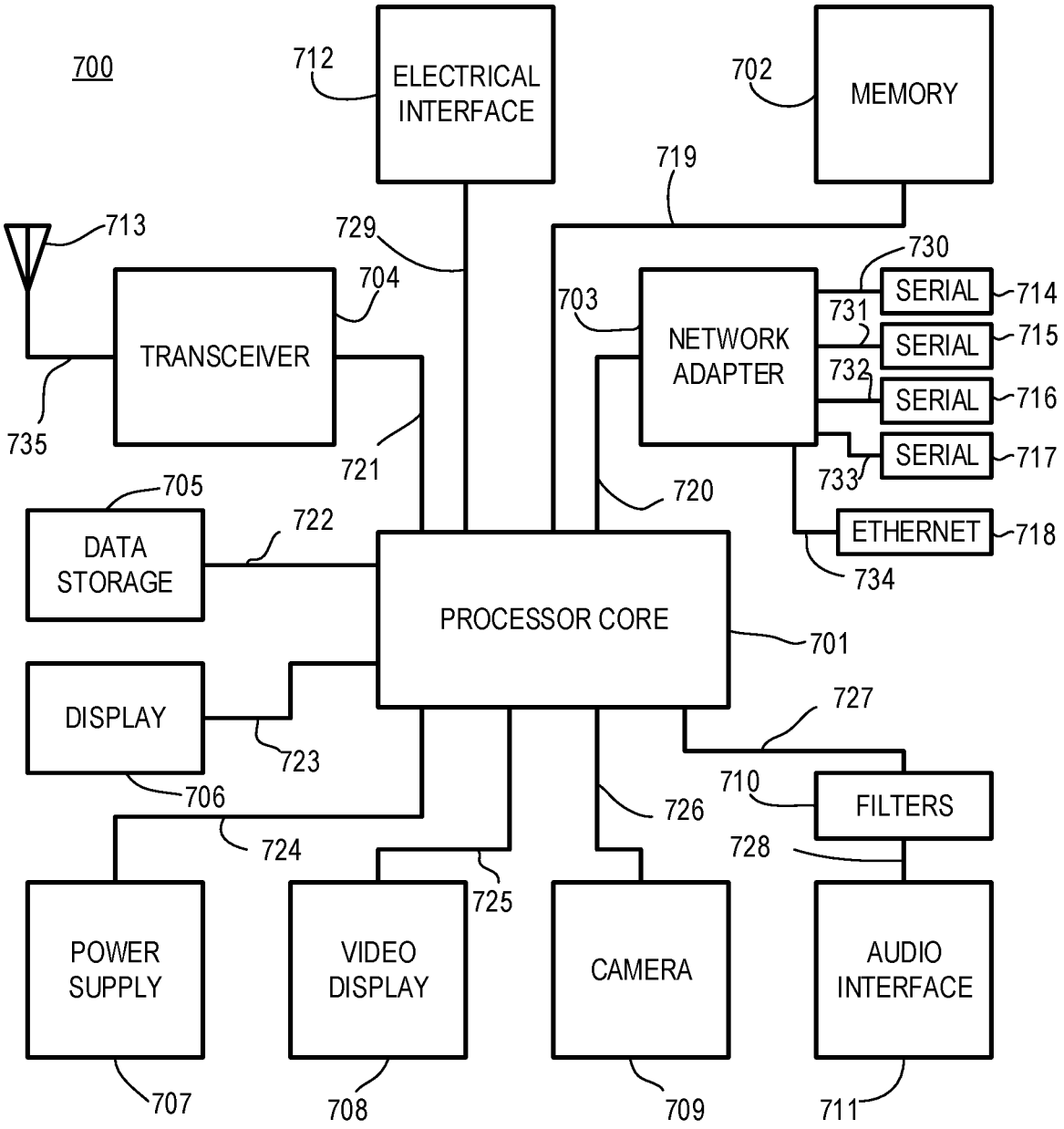
FIG. 7 is a block diagram illustrating an information processing subsystem in accordance with at least one embodiment.

FIG. 7 is a block diagram illustrating an information processing subsystem in accordance with at least one embodiment. One or more elements of the systems and subsystems described herein can be implemented digitally using an information processing subsystem, such as information processing subsystem 700. Information processing subsystem 700 comprises processor core 701, memory 702, network adapter 703, transceiver 704, data storage 705, display 706, power supply 707, video display 708, camera 709, filters 710, audio interface 711, electrical interface 712, antenna 713, serial interface 714, serial interface 715, serial interface 716, serial interface 717, and network interface 718. Processor core 701 is coupled to memory 702 via interconnect 719. Processor core 701 is coupled to network adapter 703 via interconnect 720. Processor core 701 is coupled to transceiver 704 via interconnect 721. Processor core 701 is coupled to data storage 705 via interconnect 722. Processor core 701 is coupled to display 706 via interconnect 723. Processor core 701 is coupled to power supply 707 via interconnect 724. Processor core 701 is coupled to video display 708 via interconnect 725. Processor core 701 is coupled to camera 709 via interconnect 726. Processor core 701 is coupled to filters 710 via interconnect 727. Filters 710 are coupled to audio interface 711 via interconnect 728. Network adapter 703 is coupled to serial interface 714 via interconnect 730. Network adapter 703 is coupled to serial interface 715 via interconnect 731. Network adapter 703 is coupled to serial interface 716 via interconnect 732. Network adapter 703 is coupled to serial interface 717 via interconnect 733. Network adapter 703 is coupled to network interface 718 via interconnect 734. Transceiver 704 is coupled to antenna 713 via interconnect 735. Processor core 701 is coupled to electrical interface 712 via interconnect 729.

In accordance with at least one embodiment, memory 702 may comprise volatile memory, non-volatile memory, or a combination thereof. In accordance with at least one embodiment, serial interfaces 714, 715, 716, and 717 may be implemented according to RS-232, RS-422, universal serial bus (USB), inter-integrated circuit (I2C), serial peripheral interface (SPI), controller area network (CAN) bus, another serial interface, or a combination thereof. In accordance with at least one embodiment, network interface 718 may be implemented according to ethernet, another networking protocol, or a combination thereof. In accordance with at least one embodiment, transceiver 704 may be implemented according to wifi, Bluetooth, Zigbee, Z-wave, Insteon, X10, Homeplug, EnOcean, LoRa, another wireless protocol, or a combination thereof.

Figure 8:
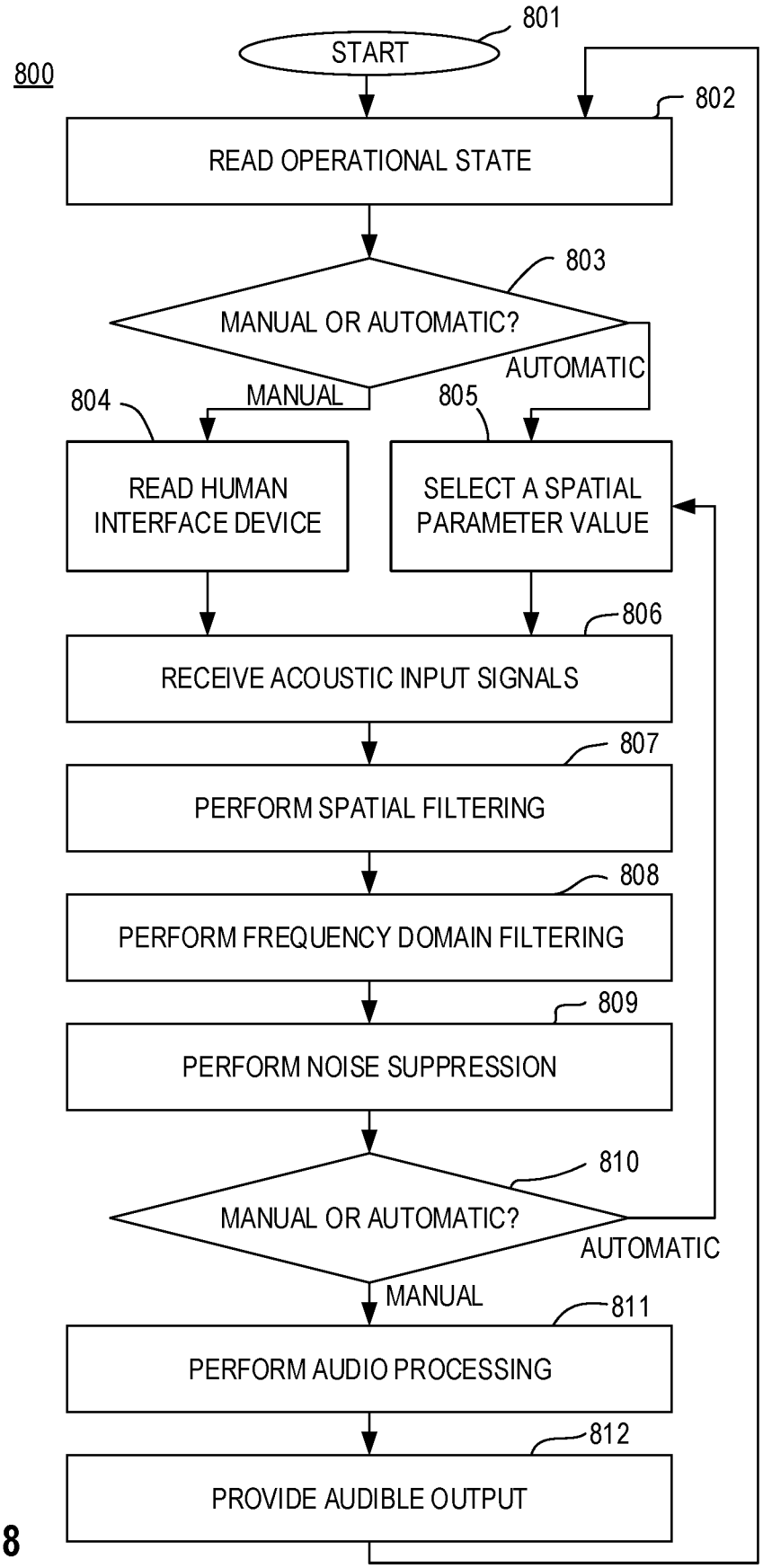
FIG. 8 is a flow diagram illustrating a method in accordance with at least one embodiment.

FIG. 8 is a flow diagram illustrating a method in accordance with at least one embodiment. Method 800 begins at block 801 and continues to block 802. At block 802, a device reads an operational state (e.g., a manual state or an automatic state). From block 802, method 800 continues to decision block 803. At decision block 803, a decision is made as to whether the device is in a manual state or an automatic state. When the device is in the manual state, method 800 continues to block 804. At block 804, the device reads a human interface device. From block 804, method 800 continues to block 806. When the device is determined to be in the automatic state at decision block 803, method 800 continues to block 805. At block 805, the device selects a spatial parameter value. From block 805, method 800 continues to block 806.

At block 806, the device receives acoustic input signals. From block 806, method 800 continues to block 807. At block 807, the device performs spatial filtering. From block 807, method 800 continues to block 808. At block 808, the device performs frequency domain filtering. From block 808, method 800 continues to block 809. At block 809, the device performs noise suppression. From block 809, method 800 continues to decision block 810. At decision block 810, a decision is made as to whether the device is in a manual state or an automatic state. When the device is in the automatic state, method 800 returns to block 805, where another spatial parameter value can be selected. When the device is determined to be in the automatic state at decision block 810, method 800 continues to block 811. At block 811, the device performs audio processing. From block 811, method 800 continues to block 812. At block 812, the device provides audible output. From block 812, method 800 returns to block 802.

While at least one embodiment is illustrated as comprising particular elements configured in a particular relationship to each other, other embodiments may be practiced with fewer, more, or different elements, and the fewer, more, or different elements may be configured in a different relationship to each other. As an example, an embodiment may be practiced omitting frequency domain filter 227 or incorporating functionality of frequency domain filtering into noise suppressor 228. In accordance with such an embodiment, spatial filter 226 may be coupled to noise suppressor 228. For example, the plurality of frequency bands that may be utilized for gain adjustment or amplitude subtraction in noise suppressor 228 may be used to implement functionality of frequency domain filtering, such as providing a voice bandpass filter. As an example, within that voice bandpass filter, addition noise filtering, such as the implementation of a comb filter, may be provided. As another example, the order of the elements of the system may be varied. For example, frequency domain filter 227 may be implemented between microphones 105, 221, 222, and 107 and spatial filter 226. Spatial filter 226 may provide its spatially filtered output signal to noise suppressor 228. As another example, a noise suppressor 228 may be implemented for each of one or more of microphones 105, 221, 222, and 107, and the output of noise suppressor 228 may be provided to spatial filter 226 or frequency domain filter 227. In accordance with at least one embodiment, audio processor 229 may be omitted or its functionality may be incorporated into noise suppressor 228. In accordance with such an embodiment, noise suppressor 228 may be coupled to audio amplifier 230. In accordance with at least one embodiment, spatial scanner 225 may be omitted or its functionality incorporated into spatial filter 226. In accordance with such an embodiment, noise suppressor 228 may be coupled to spatial filter 226 to provide a control signal to control spatial filter 226.

The concepts of the present disclosure have been described above with reference to specific embodiments. However, one of ordinary skill in the art will appreciate that various modifications and changes can be made without departing from the scope of the present disclosure as set forth in the claims below. In particular, the relationships of elements within the system can be reconfigured while maintaining interaction among the elements. Accordingly, the specification and figures are to be regarded in an illustrative rather than a restrictive sense, and all such modifications are intended to be included within the scope of the present disclosure.

Benefits, other advantages, and solutions to problems have been described above with regard to specific embodiments. However, the benefits, advantages, solutions to problems, and any feature(s) that may cause any benefit, advantage, or solution to occur or become more pronounced are not to be construed as a critical, required, or essential feature of any or all the claims.

What is claimed is:

1. Apparatus comprising:

a plurality of microphones situated at spatially diverse locations to provide microphone signals;

a spatial filter coupled to the microphones, the spatial filter configured to spatially filter the microphone signals;

a human interface device (HID) coupled to the spatial filter, the HID for receiving a manual control input and for providing control of a spatial filter parameter value of the spatial filter, the HID configured to control an angular direction for spatial filtering and an amount of spatial filtering;

a noise suppressor coupled to the spatial filter, the noise suppressor for suppressing noise after spatial filtering; and an audio amplifier, the audio amplifier coupled to the noise suppressor, the audio amplifier for amplifying an audible output signal.

2. The apparatus of claim 1 wherein the noise suppressor comprises:

an artificial neural network (ANN) for learning a noise characteristic of the noise.

3. The apparatus of claim 1 wherein the noise suppressor comprises:

a voice activity detector coupled to the spatial filter, the voice activity detector for detecting voice activity.

4. The apparatus of claim 1 further comprising:

a spatial scanner coupled to the noise suppressor and to the spatial filter, the spatial scanner coupling the noise suppressor to the spatial filter, the spatial scanner for scanning a plurality of spatial filter parameter values of the spatial filter and for receiving a feedback signal from the noise suppressor.

5. The apparatus of claim 1 further comprising:

an audio processor coupled to the noise suppressor and to the audio amplifier, the audio processor coupling the noise suppressor to the audio amplifier, the audio processor comprising a speech recognizer, the speech recognizer for recognizing speech and for providing a spatial filter feedback signal to the spatial filter and a noise suppressor feedback signal to the noise suppressor.

6. The apparatus of claim 1 wherein the spatial filter comprises:

a differential amplifier for amplifying a difference between a first microphone derived signal derived from a first microphone of the plurality of microphones and a second microphone derived signal derived from a second microphone of the plurality of microphones.

7. The apparatus of claim 1 wherein the spatial filter comprises:

a first adjustable time delay element for delaying a first microphone derived signal derived from a first microphone of the plurality of microphones; and a second adjustable time delay element for delaying a second microphone derived signal from a second microphone of the plurality of microphones, the first adjustable time delay element and the second adjustable time delay element for providing time-difference-of-arrival-based (TDOA-based) spatial filtering.

8. The apparatus of claim 1 further comprising:

a frequency domain filter coupled to the spatial filter and to the noise suppressor, the frequency domain filter coupling the spatial filter to the noise suppressor, the frequency domain filter for spectrally filtering a spatially filtered signal from the spatial filter.

9. A method comprising:

receiving acoustic input signals;

performing spatial filtering of the acoustic input signals;

scanning a plurality of spatial filtering parameter values, wherein the performing the spatial filtering of the acoustic input signals comprises performing the spatial filtering of the acoustic input signals according to each of the spatial filtering parameter values;

performing noise suppression after the performing the spatial filtering;

applying a voice activity detection indication obtained from the performing noise suppression to select an updated spatial parameter value for further spatial filtering; and providing audible output.

10. The method of claim 9 further comprising:

performing frequency domain filtering.

11. The method of claim 9 further comprising:

reading a human input device (HID) to obtain a spatial filtering parameter value, wherein the performing the spatial filtering of the acoustic input signals comprises performing the spatial filtering of the acoustic input signals according to the spatial filtering parameter value, the HID configured to control an angular direction for spatial filtering and an amount of spatial filtering.

12. The method of claim 9 wherein the performing the spatial filtering of the acoustic input signals comprises:

amplifying an amplitude difference between a first amplitude of a first acoustic input signal from a first microphone and a second amplitude of a second acoustic input signal from a second microphone, the first microphone and the second microphone situated at spatially diverse locations.

13. The method of claim 9 wherein the performing the spatial filtering of the acoustic input signals comprises:

introducing a temporal delay to a second timing of a second acoustic input signal from a second microphone with respect to a first timing of a first acoustic input signal from a first microphone, the first microphone and the second microphone situated at spatially diverse locations.

14. The method of claim 9 further comprising:

performing speech recognition on a noise-suppressed signal;

adjusting the spatial filtering based on a first metric of the speech recognition; and adjusting the noise suppression based on a second metric of the speech recognition.

15. The method of claim 9 wherein the performing noise suppression comprises:

performing the noise suppression using an artificial neural network (ANN).

16. An apparatus comprising:

a plurality of microphones situated at spatially diverse locations to provide microphone signals;

a spatial filter coupled to the microphones, the spatial filter configured to spatially filter the microphone signals;

a noise suppressor coupled to the spatial filter, the noise suppressor for suppressing noise according to a recurrent neural network (RNN);

an audio processor coupled to the noise suppressor, the audio processor comprising a speech recognizer, the speech recognizer providing a spatial filter feedback signal to control the spatial filter and a noise suppressor feedback signal to control the noise suppressor; and an audio amplifier, the audio amplifier coupled to the audio processor, the audio amplifier for amplifying an audible output signal.

17. The apparatus of claim 16 further comprising:

a human interface device (HID) coupled to the spatial filter, the HID for receiving a manual control input and for providing control of a spatial filter parameter value of the spatial filter, the HID configured to control an angular direction for spatial filtering and an amount of spatial filtering.

18. The apparatus of claim 16 further comprising:

a spatial scanner coupled to the noise suppressor and to the spatial filter, the spatial scanner coupling the noise suppressor to the spatial filter, the spatial scanner for scanning a plurality of spatial filter parameter values of the spatial filter and for receiving a feedback signal from the noise suppressor.

* * * * *